US012116996B2

(12) United States Patent
Narisawa et al.

(10) Patent No.: US 12,116,996 B2
(45) Date of Patent: Oct. 15, 2024

(54) COMPRESSOR WITH PISTON RING ARRANGEMENT ON PISTON

(71) Applicant: Hitachi Industrial Equipment Systems Co., Ltd., Tokyo (JP)

(72) Inventors: Nobuyuki Narisawa, Tokyo (JP); Ken Umeda, Tokyo (JP); Sho Goto, Tokyo (JP); Tatsuya Suzuki, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 119 days.

(21) Appl. No.: 17/420,755

(22) PCT Filed: Mar. 10, 2020

(86) PCT No.: PCT/JP2020/010183

§ 371 (c)(1),
(2) Date: Jul. 6, 2021

(87) PCT Pub. No.: WO2021/065038

PCT Pub. Date: Apr. 8, 2021

(65) Prior Publication Data

US 2022/0106950 A1 Apr. 7, 2022

(30) Foreign Application Priority Data

Oct. 1, 2019 (JP) ..... 2019-181198

(51) Int. Cl.
*F04B 53/14* (2006.01)
*F04B 39/00* (2006.01)
*F04B 39/14* (2006.01)

(52) U.S. Cl.
CPC ..... *F04B 53/143* (2013.01); *F04B 39/0005* (2013.01); *F04B 39/0022* (2013.01); *F04B 39/14* (2013.01); *F04B 53/144* (2013.01)

(58) Field of Classification Search
CPC .... F04B 53/143; F04B 39/0022; F04B 39/14; F04B 53/144; F04B 39/0005; F16J 1/12; F16J 1/008; F16J 1/005; F02F 3/0023
See application file for complete search history.

(56) References Cited

U.S. PATENT DOCUMENTS 2,710,137 A * 6/1955 Arnouil ..... F01B 9/02 417/490
2,792,790 A * 5/1957 Capps ..... F04B 39/126 184/18

(Continued)

FOREIGN PATENT DOCUMENTS

DE 102008032884 A1 * 1/2010
EP 1 527 279 B1 4/2008

(Continued)

OTHER PUBLICATIONS

English Translation of DE102008032884A1 from Espacenet on Jun. 1, 2023 (Year: 2023).*

(Continued)

*Primary Examiner* — Bryan M Lettman
(74) *Attorney, Agent, or Firm* — Crowell & Moring LLP

(57) ABSTRACT

There is provided a compressor including: a piston that reciprocates inside a cylinder; a valve plate that closes an end portion of the cylinder; a connecting rod that supports the piston; a crankshaft that applies a rotating force to an end portion of the connecting rod; and a crankcase that rotatably supports the crankshaft. The piston is an oscillating piston that reciprocates while oscillating inside the cylinder according to rotation of the crankshaft. An outer peripheral surface of the piston is a curved surface.

14 Claims, 12 Drawing Sheets

(56) References Cited

U.S. PATENT DOCUMENTS

| | | | | | |
|---|---|---|---|---|---|
| 3,082,935 | A * | 3/1963 | Arak | F04B 29/00 | 417/489 |
| 3,716,310 | A * | 2/1973 | Guenther | F04B 39/0016 | 91/422 |
| 3,961,868 | A * | 6/1976 | Droege, Sr. | F04B 39/0005 | 92/155 |
| 4,028,015 | A * | 6/1977 | Hetzel | F04B 39/12 | 417/415 |
| 4,246,833 | A * | 1/1981 | Burklund | F16J 1/001 | 92/155 |
| 4,275,999 | A * | 6/1981 | Hetzel | F04B 39/0016 | 417/299 |
| 4,350,352 | A * | 9/1982 | Kolarik | F16J 9/20 | 277/455 |
| 4,540,352 | A * | 9/1985 | Becker | F04B 53/143 | 92/240 |
| 5,947,702 | A * | 9/1999 | Biederstadt | F04B 53/143 | 92/87 |
| 8,206,137 | B2 * | 6/2012 | Sakamoto | F04B 53/162 | 417/571 |
| 8,430,650 | B2 * | 4/2013 | Ohata | F04B 39/0016 | 92/240 |
| 8,887,621 | B2 * | 11/2014 | Ohata | F04B 39/0016 | 92/240 |
| 10,215,283 | B2 | 2/2019 | Maeda | | |
| 2006/0193735 | A1 * | 8/2006 | Suzuki | F16J 15/3268 | 277/436 |
| 2009/0136373 | A1 * | 5/2009 | Adler | F04B 39/121 | 418/63 |
| 2011/0277626 | A1 * | 11/2011 | Asai | F04B 39/0022 | 92/172 |
| 2012/0020821 | A1 * | 1/2012 | Asai | F04B 39/0005 | 417/437 |
| 2014/0014060 | A1 | 1/2014 | Richt | | |
| 2014/0020553 | A1 * | 1/2014 | Harashima | F04B 39/0005 | 92/66 |
| 2014/0283680 | A1 * | 9/2014 | Chou | F04B 53/143 | 92/169.1 |
| 2015/0209986 | A1 * | 7/2015 | Sommer | F04B 1/0408 | 264/279 |
| 2016/0201660 | A1 * | 7/2016 | Yang | F04B 39/12 | 92/162 R |
| 2019/0234389 | A1 * | 8/2019 | Yang | F04B 39/08 | |

FOREIGN PATENT DOCUMENTS

| | | | |
|---|---|---|---|
| JP | 48-6449 | | 1/1973 |
| JP | 59-231261 | A | 12/1984 |
| JP | 64-12078 | A | 1/1989 |
| JP | 64-32477 | U | 3/1989 |
| JP | 5-157049 | A | 6/1993 |
| JP | 6-15663 | A | 1/1994 |
| JP | 11-325245 | A | 11/1999 |
| JP | 2000-257555 | A | 9/2000 |
| JP | 2001-271744 | A | 10/2001 |
| JP | 2014-126001 | A | 7/2014 |
| JP | 2015-132267 | A | 7/2015 |
| JP | 3206366 | U | 9/2016 |
| JP | 2017-110608 | A | 6/2017 |
| WO | WO 2015/156144 | A1 | 10/2015 |

OTHER PUBLICATIONS

International Search Report (PCT/ISA/210) issued in PCT Application No. PCT/JP2020/010183 dated Jun. 2, 2020 with English translation (six (6) pages).

Japanese-language Written Opinion (PCT/ISA/237) issued in PCT Application No. PCT/JP2020/010183 dated Jun. 2, 2020 (four (4) pages).

Extended European Search Report issued in European Application No. 20872803.0 dated Sep. 6, 2023 (10 pages).

Japanese-language Office Action issued in Japanese Application No. 2019-181198 dated Feb. 13, 2024 with English translation (6 pages).

* cited by examiner

COMPRESSOR WITH PISTON RING ARRANGEMENT ON PISTON

TECHNICAL FIELD

The present invention relates to a compressor.

BACKGROUND ART

As a reciprocating compressor of the related art which compresses a fluid, there are a normal piston type in which a bearing is provided in an end portion on a compression chamber side of a connecting rod and which includes a piston that is oscillatably supported by the bearing, and an oscillating piston type which does not include a bearing on a compression chamber side of a connecting rod and in which a piston integrated with the connecting rod includes a seal ring that is elastically deformed to seal a compressed fluid.

The oscillating piston type of the latter has a structure simpler than that of the normal piston type since the oscillating piston type does not include the bearing or a piston pin, and has many merits such as that the design is not limited by the temperature of the bearing or that the mass subjected to a reciprocating motion can be reduced.

However, meanwhile, when the range of the inclination angle (oscillation angle) of the connecting rod increases while the crankshaft rotates one revolution, or when the inner diameter of the cylinder increases, problems occur such as uneven wear, breakage, or a deterioration in sealing performance of the seal ring to be described later. For this reason, generally, a product of the oscillating piston type is implemented only in a small reciprocating compressor having a relatively short piston stroke and a small oscillation angle.

Regarding the reciprocating compressor, as illustrated in Patent Document 1, there is a technique by which the shape in a circumferential direction of a lip is devised to reduce the influence of a biased load. In addition, Patent Document 2 illustrates a structure in which apart from a piston ring that seals a compression chamber, a liner is provided as a guide for both the reciprocating motion and the oscillating motion of a piston to avoid the piston ring itself from receiving an oscillating inertia force. Since the liner itself can come into contact with a cylinder inner peripheral surface, the structure has a function of filling a cylinder gap in a main axial direction and aligning both the piston and a cylinder to each other to some extent even during assembly.

CITATION LIST

Patent Document

Patent Document 1: JP 2017-110608 A
Patent Document 2: JP 2015-132267 A

SUMMARY OF THE INVENTION

Problems to be Solved by the Invention

In Patent Document 1, the shape in the circumferential direction of the lip is a complicated shape. For this reason, the initial production investment is very large. Further, since a lip portion is subjected to deformation, the sealing performance of a ring itself deteriorates, which is another problem. In addition, countermeasures against an incident that the lip portion is subjected to repeated bending deformation to be fatigued and broken when the piston reciprocates while oscillating inside a cylinder are not taken into consideration.

In the structure of Patent Document 2, as illustrated in FIG. 11, a cutout is provided on a lower side of a piston ring 39, so that the piston ring is not sufficiently supported. For this reason, eventually, deformation occurs in which the piston ring falls into the cylinder gap when the oscillation angle increases. In addition, since a corner of the piston ring has a protruding shape, the piston ring interferes with the cylinder, which is a problem.

In addition, since the piston ring has high rigidity, the followability with respect to an inner wall surface of the cylinder during oscillation is worse than that of the lip ring, and when the oscillation angle increases, the sealing performance greatly decreases, which is a problem.

To summarize the above contents, in the oscillating piston type of the related art, the sealing performance and the problem of strength of the seal ring are in the relationship of trade-off, and it is difficult to achieve both the sealing performance and the strength. In addition, when the piston ring is used, deformation in which the piston ring falls into gaps (cylinder gaps in the main axial direction and an oscillation direction) between the piston and the cylinder and the problem of interference between the piston and the cylinder are also in the same relationship of trade-off.

An object of the present invention is to prevent a seal ring from being deformed or broken or deteriorating in sealing performance as the oscillation angle increases.

Solutions to Problems

According to one preferred example of the present invention, there is provided a compressor including: a piston that reciprocates inside a cylinder; a valve plate that closes an end portion of the cylinder; a connecting rod that supports the piston; a crankshaft that applies a rotating force to an end portion of the connecting rod; and a crankcase that rotatably supports the crankshaft.

The piston is an oscillating piston that reciprocates while oscillating inside the cylinder according to rotation of the crankshaft.

An outer peripheral surface of the piston is a curved surface.

Effects of the Invention

According to the present invention, a seal ring can be prevented from being deformed or broken or deteriorating in sealing performance as the oscillation angle increases.

MODE FOR CARRYING OUT THE INVENTION

Hereinbelow, embodiments of the present invention will be described in detail with reference to the drawings.

First Embodiment

Figure 1:
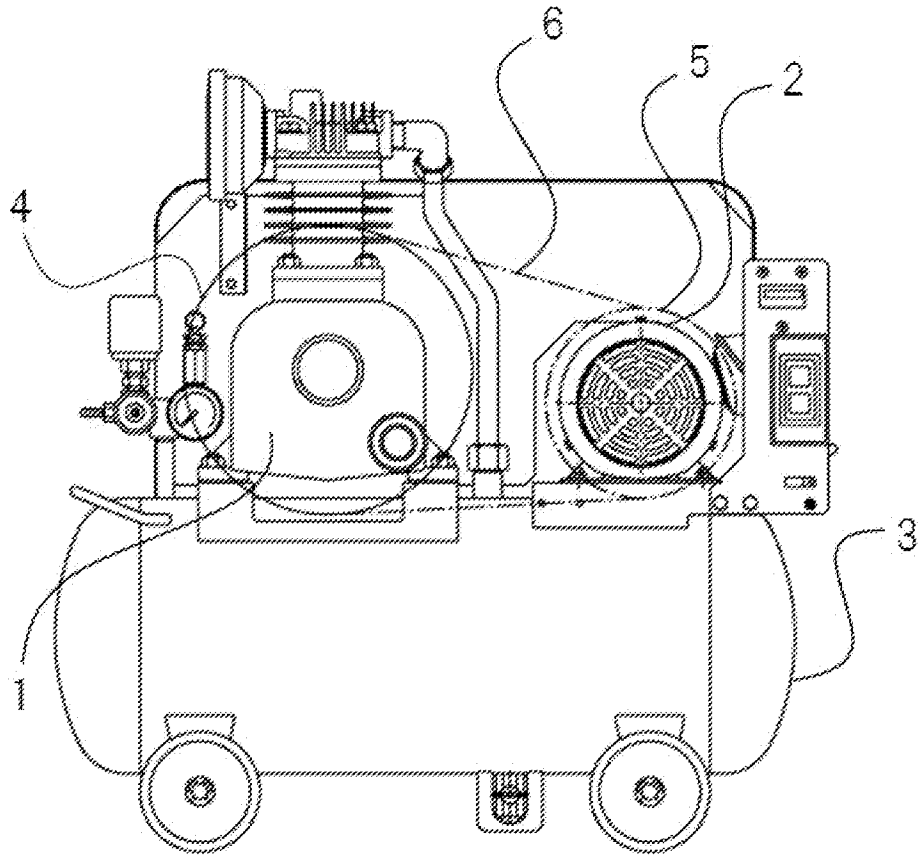
FIG. 1 is a view illustrating a configuration example of the entirety of a compressor in a first embodiment.

FIG. 1 illustrates a schematic view of a compressor in a first embodiment. In addition, FIG. 2 illustrates the internal structure of a compressor main body 1 in FIG. 1.

The compressor illustrated in FIG. 1 includes the compressor main body 1, an electric motor 2 that drives the compressor main body 1, and a tank 3 that stores a fluid discharged by the compressor main body 1. The compressor main body 1 compresses a fluid, and as illustrated in FIG. 2, the internal structure thereof includes a crankcase 21, one cylinder 22 that protrudes from the crankcase 21 in a vertical direction, a valve plate 26 that closes an end portion (end portion of an upper portion) of the cylinder 22, a cylinder head 23, and a crankshaft 24 that is rotatably supported at the center of the crankcase 21.

When the crankshaft 24 inside the crankcase 21 rotates, a rotating force is applied to an end portion of a connecting rod 32 to cause a piston 33, which is installed inside the cylinder 22, to reciprocate in the vertical direction, and as a result, the compressor main body 1 suctions a fluid from outside the cylinder, compresses the fluid, and discharges the compressed fluid.

Figure 2:
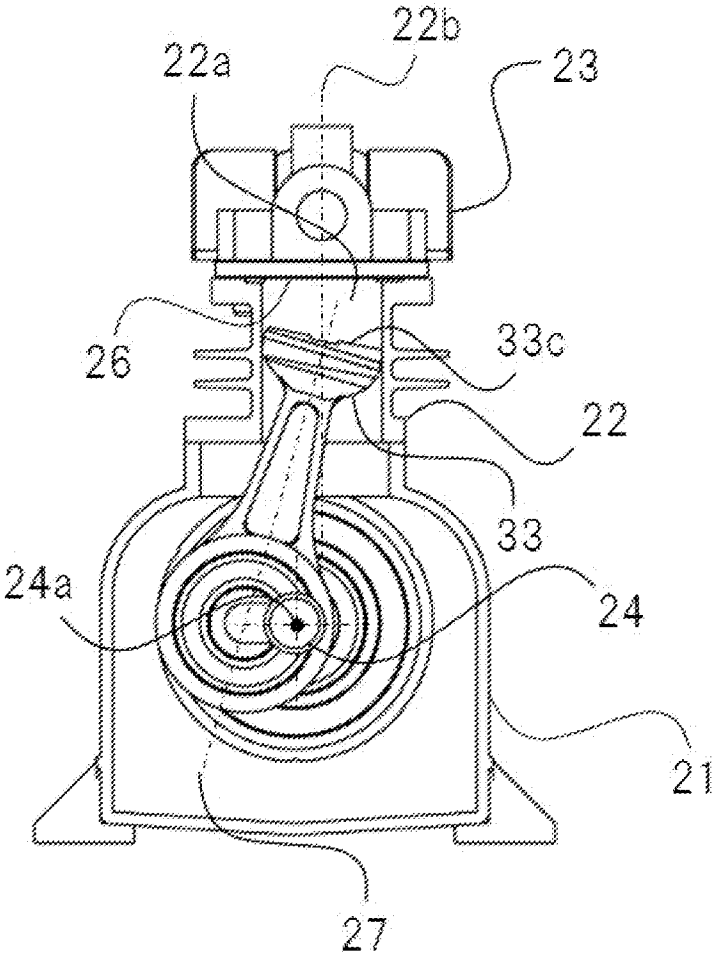
FIG. 2 is a view illustrating an internal configuration of a compressor main body in the first embodiment.

Incidentally, in FIGS. 1 and 2, for simplicity of description, the compressor is illustrated as a single cylinder and single stage compressor including only a pair of a piston and a cylinder, but may be a compressor including a plurality of pistons and cylinders in series or radially with respect to a crankshaft.

The compressor main body 1 is disposed on and fixed to the tank 3 in a state where the crankshaft 24 is disposed in parallel to a rotating shaft of the electric motor 2. A compressor pulley 4 is fixed to the crankshaft 24, and an electric motor pulley 5 is fixed to an electric motor shaft. The compressor pulley 4 provided in the compressor main body 1 includes blades, and as the blades rotate, cooling air is generated toward the compressor main body 1 to promote heat dissipation of the compressor main body 1.

A power transmission belt 6 which transmits power between the compressor pulley 4 and the electric motor pulley 5 is wound around the compressor pulley 4 and the electric motor pulley 5. Accordingly, as the electric motor 2 rotates, the crankshaft 24 of the compressor main body 1 is rotationally driven via the electric motor pulley 5, the power transmission belt 6, and the compressor pulley 4, so that the compressor main body 1 compresses a fluid.

Incidentally, in FIG. 1, for simplicity of description, the compressor main body 1 is configured to be connected to the electric motor 2 via the power transmission belt 6; however, the compressor may be such that the compressor main body 1 and the electric motor 2 are integrated by directly joining the crankshaft 24 of the compressor main body 1 and the rotating shaft of the electric motor 2 using combining means such as a coupling.

The structure around the piston in FIG. 2 will be described. The piston 33 of FIG. 2 is an oscillating piston type in which the piston is integrally formed with the connecting rod 32. In this type, as the crankshaft 24 rotates, the piston 33 reciprocates while oscillating inside the cylinder 22.

Figure 3A:
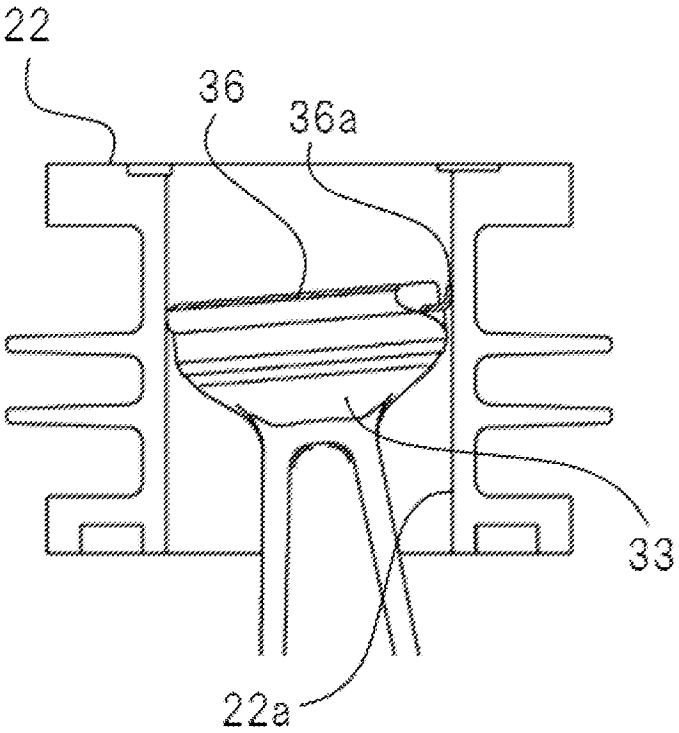
FIG. 3A is a view illustrating an oscillating piston structure using a lip ring.
Figure 3B:
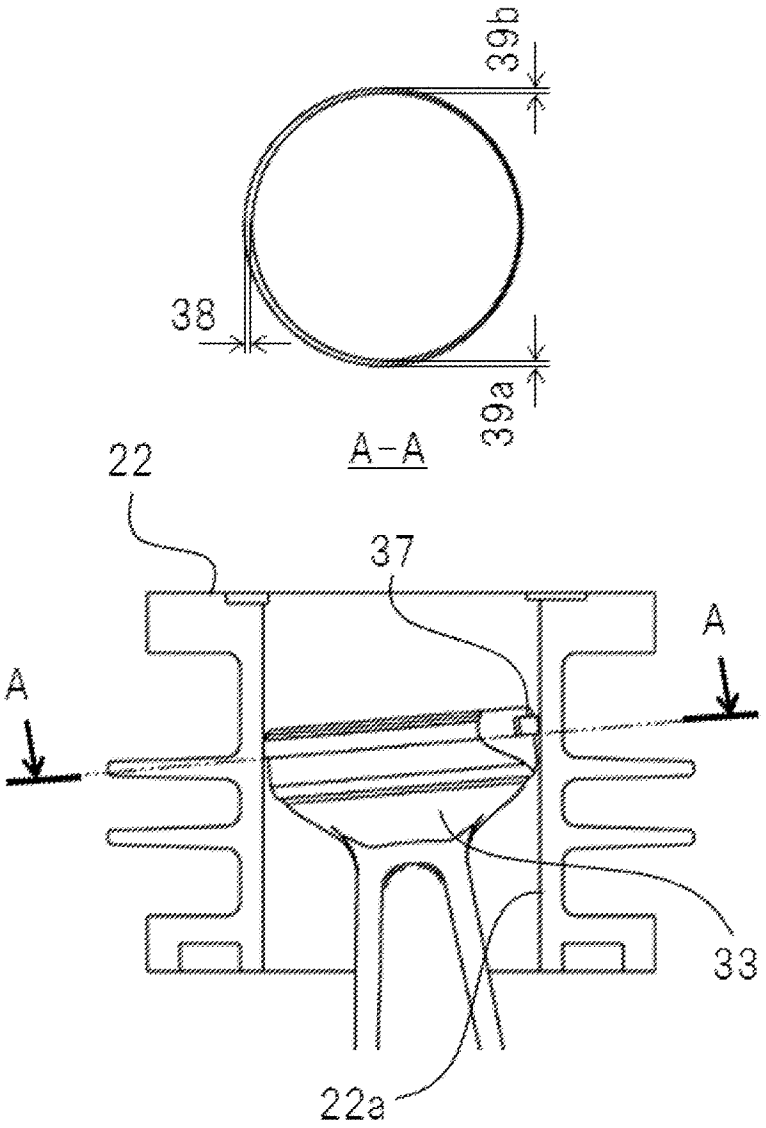
FIG. 3B is a view illustrating an oscillating piston structure using a piston ring.

In the oscillating piston type, as a main seal ring structure, the piston 33 may include a lip ring 36 in contact with a cylinder inner peripheral surface 22*a* as illustrated in FIG. 3A, or the piston 33 may include a piston ring 37 in contact with the cylinder inner peripheral surface 22*a* as illustrated in FIG. 3B.

Here, an A-A cross section of a lower figure of FIG. 3B is illustrated in an upper figure of FIG. 3B. A cylinder gap 38 in an oscillation direction and cylinder gaps 39*a* and 39*b* in a main axial direction are generated between the piston 33 and the cylinder inner peripheral surface 22*a*. Here, the cylinder gap in the main axial direction refers to a gap between the piston and the cylinder in a crankshaft direction. In addition, the cylinder gap in the oscillation direction refers to a gap between the piston and the cylinder in a piston oscillation direction.

It is known that another problem occurs such as that since the shift of a central axis with respect to the cylinder inner peripheral surface increases particularly the cylinder gaps in the main axial direction, deformation occurs in which the piston ring that has received a gas load at compression falls into the gaps.

In addition, apart from the influence of the shift of the central axis with respect to the cylinder inner peripheral surface, the cylinder gap in the oscillation direction is also greatly increased or decreased by the oscillation angle of the piston, thereby causing the same problem. In order to narrow the gaps, it is indispensable to increase the outer diameter of a lower surface of a ring groove to which the piston ring is fitted; however, naturally, when the outer diameter is too large, interference with the cylinder occurs, so that there is a limit. The present embodiment solves these problems.

In each seal ring type, the following problems occur as the oscillation angle increases.

<Lip Ring>

(A) When a lip portion 36*a* repeatedly comes into contact with the cylinder inner peripheral surface 22*a*, bending stress increases, and thus fatigue breakage occurs in the vicinity of the root of a rounded portion.

(B) When the piston is inserted into the cylinder 22 to be fixed to the crankcase 21, if central axes of the lip ring 36 and the cylinder inner peripheral surface 22*a* are shifted from each other, the lip ring is fixed in a state where the lip ring receives a load pressing the cylinder inner peripheral surface, so that uneven wear occurs over the elapse of the operation time.

<Piston Ring>

(C) Since there is no component such as the lip ring 36 which guides the piston 33, there is a risk that upper and lower end corners of the piston 33 interfere with the cylinder inner peripheral surface 22*a*. When a relief cut is provided at the lower end corner to avoid interference, the area of the lower surface of the ring groove that supports the piston ring 37 which has received a gas load is reduced. Therefore, the cylinder gap 38 in the oscillation direction is increased, thereby causing deformation in which the piston ring falls into the gap.

(D) Deformation occurs in which the piston ring falls into the cylinder gaps 39*a* and 39*b* in the main axial direction caused by a shift between central axes of the piston 33 and the cylinder 22 when the cylinder 22 is fixed to the crankcase 21, or the cylinder gap 38 in the oscillation direction generated simply when the oscillation angle increases.

(E) Since the piston ring is thicker and more rigid than the lip ring, the followability with respect to the cylinder inner peripheral surface 22*a* during oscillation deteriorates, the sealing performance decreases, and the blowby loss increases.

Figure 3C:
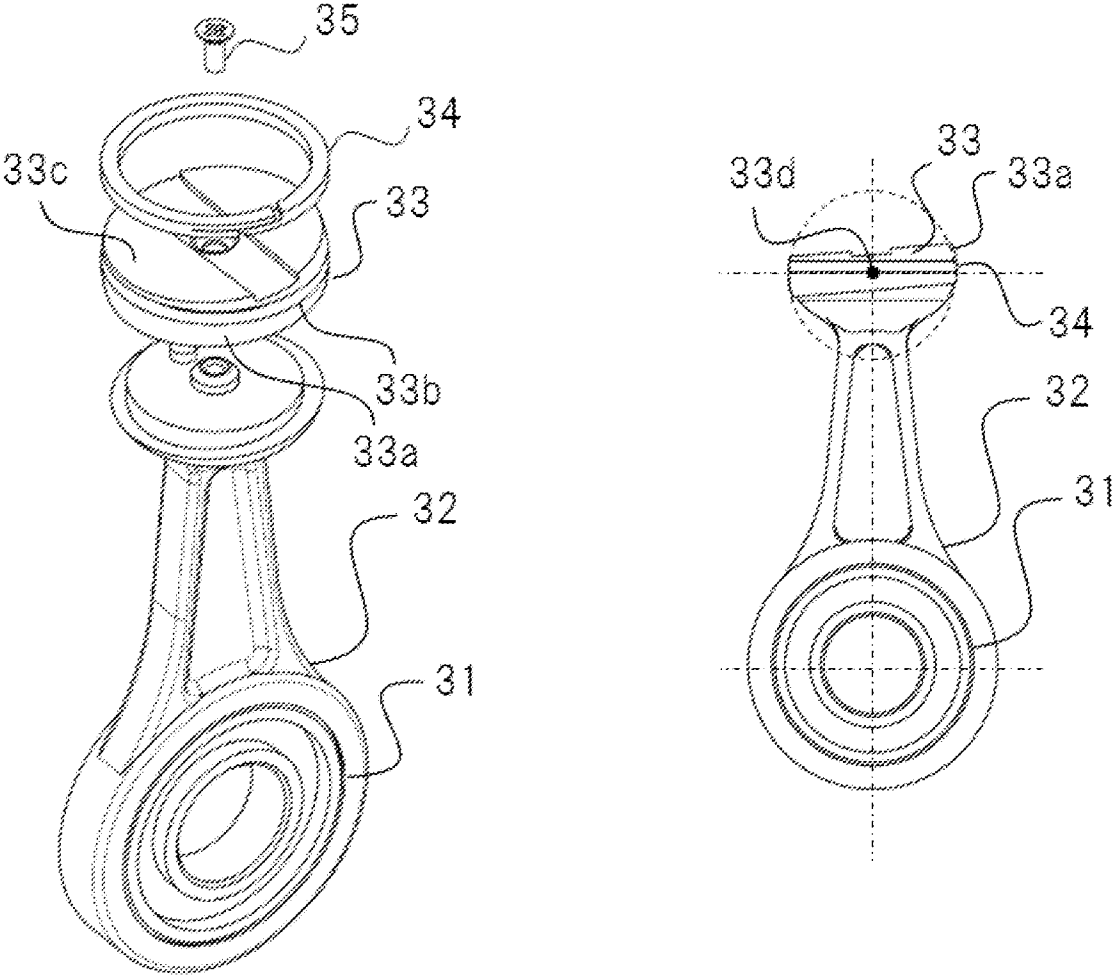
FIG. 3C is a view illustrating an oscillating piston structure using a piston ring in the first embodiment.

In order to solve the above problems (A) to (E), in the first embodiment, the oscillating piston illustrated in FIG. 3C is used. The left figure of FIG. 3C is a perspective view, and the right figure is a view illustrating the shape of the oscillating piston.

In FIG. 3C, the piston 33 is formed as a component separate from the connecting rod 32, and the piston 33 is fastened (fixed) to the connecting rod 32 in a reciprocating direction with a screw 35.

In addition, an outer peripheral surface 33*a* of the piston 33 is a spherical surface having a diameter slightly smaller than the diameter of the cylinder. A piston ring 34 is used as a seal ring that seals a compressed gas, and the piston ring 34 is fitted to a ring (annular shape) groove 33*b*, which is provided in the outer peripheral surface 33*a* of the piston 33, with a certain gap therebetween. Incidentally, instead of using the piston ring 34 and the ring groove 33*b*, the configuration illustrated in FIG. 3D may be adopted.

When the compressor main body 1 is an oil-free type in which an oil is not used for lubrication of sliding parts, the piston 33 is made of a resin material having good wear resistance. Accordingly, the outer peripheral surface 33*a* of the piston can directly slide against the cylinder inner peripheral surface 22*a*.

In addition, an extension line of a central axis 22*b* of the cylinder inner peripheral surface 22*a* in FIG. 2 is offset by a distance e with respect to a rotation center 24*a* of the crankshaft 24. In addition, an upper surface 33*c* of the piston 33 is not orthogonal to a straight line 27 connecting the center of a big end portion bearing 31 of the connecting rod and the center of the spherical outer peripheral surface 33*a* of the piston.

Figure 4:
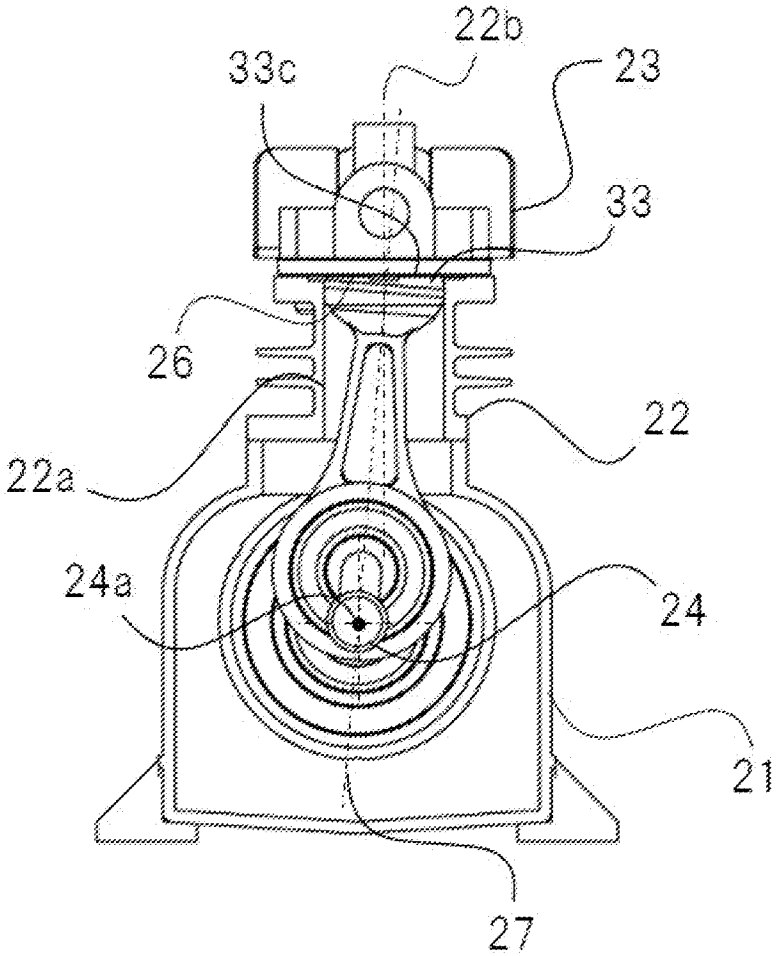
FIG. 4 is a view illustrating an internal configuration (state of a top dead center) of the compressor main body in the first embodiment.

In addition, the upper surface 33*c* is designed to be parallel to a lower surface of the valve plate 26 at a top dead center at which a center point of the spherical outer peripheral surface 33*a* of the piston is farthest from the rotation center 24*a* of the crankshaft, namely, at the crank angle illustrated in FIG. 4.

The present embodiment has the following merits.

Since the spherical outer peripheral surface 33*a* of the piston can directly slide against the cylinder inner peripheral surface 22*a*, the piston 33 can be allowed to interfere with the cylinder 22. In addition, even when the oscillation angle increases, the upper and lower end corners of the piston 33 do not come into contact with the cylinder inner peripheral surface 22*a*, so that wear or frictional loss caused by angled contact can be prevented.

Figure 3D:
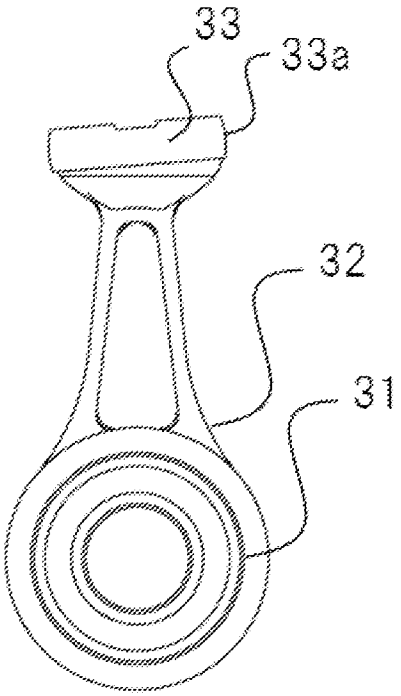
FIG. 3D is a view illustrating the oscillating piston structure in the first embodiment.

Further, referring to FIG. 3D, the spherical outer peripheral surface 33*a* of the piston can be always in contact with the cylinder 22 on a plane orthogonal to a central axis of the cylinder 22, or maintain a very small gap therebetween. Accordingly, there are great merits that the spherical outer peripheral surface 33*a* of the piston itself can seal a compression chamber and the sealing performance thereof is not affected by the oscillation angle.

However, in view of the ease to assemble and the thermal expansion of the piston 33 or the amount of crush deformation caused by the internal pressure of the compression chamber to be described later, it is desirable that a very small gap is provided between the spherical outer peripheral surface 33*a* of the piston and the cylinder inner peripheral surface 22*a* in an initial state at room temperature. In this case, when the piston ring 34 is provided as illustrated in FIG. 3C, the piston ring 34 can seal this gap.

Even in both the configurations of FIGS. 3C and 3D, since the spherical outer peripheral surface 33*a* of the piston is substantially in contact with the cylinder inner peripheral surface 22*a* in all oscillation angles in a reciprocating motion of the piston 33, the piston 33 can be prevented from vibrating in a rattling manner at the cylinder gap in the oscillation direction, and a smooth reciprocating motion is enabled.

In addition, even during assembly, assembly is performed while bringing the outer peripheral surface 33*a* of the piston into contact with the cylinder inner peripheral surface 22*a*, so that the shift between the central axes of both the surfaces can be more greatly reduced than in the oscillating piston type of the related art. Accordingly, the cylinder gaps in the main axial direction caused by misalignment during assembly can be minimized. Therefore, in the configuration of FIG. 3C, the blowby loss can be reduced, and deformation in which the piston ring 34 falls into the cylinder gaps can be prevented from occurring.

In this configuration, not only the cylinder gaps in the main axial direction but also the cylinder gap in the oscillation direction can also be more greatly reduced than in the oscillating piston type of the related art. However, the cylinder gap in the oscillation direction inevitably increases as the oscillation angle increases.

In order to suppress the maximum value of the cylinder gap in the main axial direction or the cylinder gap in the oscillation direction, a center point 33*d* of the spherical outer peripheral surface 33*a* of the piston may be disposed on a plane obtained by extending the lower surface of the ring groove (crankcase side surface of the ring groove) of the piston 33 in FIG. 3C in an inner direction of the piston.

Meanwhile, when in terms of layout, it is difficult to implement disposition in which the plane obtained by extending the lower surface of the ring groove as described above and the center point 33*d* of the spherical outer peripheral surface 33*a* of the piston coincide with each other, substantially the same effects can be achieved by locating the center point 33*d* between planes obtained by extending upper and lower surfaces of the ring groove (the upper surface of the ring groove is a valve plate side surface of the ring groove, and the lower surface of the ring groove is the crankcase side surface of the ring groove) of the piston 33 in the inner direction of the piston.

Further, according to this configuration, the piston 33 is made of a resin having low thermal conductivity, so that the amount of heat transferred to the big end portion bearing of the connecting rod due to compression heat during operation can be greatly reduced. When the big end portion bearing 31 of the connecting rod is, for example, a grease sealed bearing, this effect is exhibited to prevent a thermal deterioration in grease, so that the maintenance life thereof can be extended.

Incidentally, in the present embodiment, the piston is made of a resin having good wear resistance based on the assumption that the compressor main body 1 is a non-lubricating type in which a lubricant is not used for lubrication of the sliding parts.

However, this configuration can also be applied to a lubricating type. In this case, a lubricant film may intervene between the cylinder 22 and the spherical outer peripheral surface 33*a* of the piston by splash lubrication or the like to lubricate sliding surfaces. In this configuration, for example, a part or the entirety of the piston 33 can also be made from aluminum and integrally formed with the connecting rod 32, so that the number of components and the assembly man-hours can be reduced.

Second Embodiment

In the present embodiment, a configuration will be described in which the sealing performance of the compression chamber and sliding loss can be further suppressed than in the first embodiment. The same configuration example as that of FIGS. 3C and 3D is used.

In the first embodiment, the piston 33 is made of a resin having good wear resistance, and meanwhile, when the resin receives compression heat, generally, the resin expands thermally more than the cylinder 22 made of an aluminum alloy, cast iron, or the like. Therefore, even when the piston 33 has dimensions to create a very small gap in an initial state at room temperature, the piston 33 slides in a state where the piston 33 generates a certain surface pressure on the cylinder inner peripheral surface 22*a* to be pressed thereagainst during compression operation.

As a result, the frictional loss and the electric power consumption increase rapidly, and the temperature of the entirety of the compressor main body 1 rises in an accelerating manner, which is a problem. On the other hand, when the gap is set large to avoid the above problem, the piston ring falls into the cylinder gap as described in the first embodiment. Therefore, it is eventually desirable that the gap is small.

As countermeasures, the following configuration is adopted in the present embodiment. Originally, the resin material forming the piston 33 is required to have good wear resistance, and a resin having a small coefficient of thermal expansion is selected to suppress a rapid increase in surface pressure caused by thermal expansion during compression operation.

Incidentally, as a resin material having good wear resistance, for example, polytetrafluorooethylene (hereinafter, referred to as PTFE) is generally used as the material of a main body of the piston 33. Further, in view of the coefficient of thermal expansion, polyethersulfone (hereinafter, referred to as PES), polyphenylenesulfide (hereinafter, referred to as PPS), a phenolic resin, a polyimide resin, a copna resin, and a mixture thereof are suitable as the resin material of the piston 33.

Incidentally, generally, the coefficient of thermal expansion of the resin material has anisotropy. Namely, there is a characteristic that the coefficient of thermal expansion is larger in a direction orthogonal to a certain direction than in the direction, and the directionality differs depending on molding conditions. In a case where the piston 33 is molded with such a material, in order to suppress the generation of the surface pressure caused by thermal expansion described above, molding has to be performed such that a direction in which the thermal expansion is small is perpendicular to the reciprocating direction when the piston 33 is at the top dead center. With such molding, the thermal expansion of the spherical outer peripheral surface of the piston is smaller in a direction perpendicular to the reciprocating direction than in the reciprocating direction in a state where the piston is at the top dead center. With such a configuration, both the cylinder gap and an increase in surface pressure caused by thermal expansion can be suppressed.

Further, in this case, the shape of the spherical outer peripheral surface 33*a* of the piston is a shape into which a perfect sphere slightly collapses during operation due to the anisotropy of the coefficient of thermal expansion. Accordingly, a gap is generated at a certain oscillation angle, but the piston is pressed against the cylinder inner peripheral surface 22*a* at a certain oscillation angle, thereby causing frictional loss, which is a problem.

For this reason, the spherical outer peripheral surface 33*a* of the piston is designed to have a shape close to a perfect sphere at operating temperature, namely, to be the spherical surface of a substantially perfect sphere. It is ideal that the spherical outer peripheral surface has a crushed spherical shape at room temperature such that the spherical surface of a substantially perfect sphere is obtained at the operating temperature. As described above, when processing is performed such that a direction in which the coefficient of thermal expansion is large is the reciprocating direction and the direction in which the coefficient of thermal expansion is small is the direction perpendicular to the reciprocating direction in a state where the piston 33 is at the top dead center, the ideal shape of the spherical outer peripheral surface 33*a* of the piston is an ellipsoid having a minor diameter in the reciprocating direction and a major diameter in the direction perpendicular thereto.

Third Embodiment

Figure 5A:
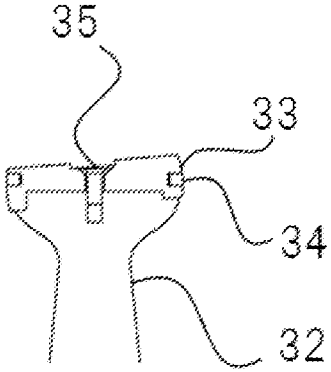
FIG. 5A is a view illustrating a method for fixing a piston in a third embodiment.
Figure 5B:
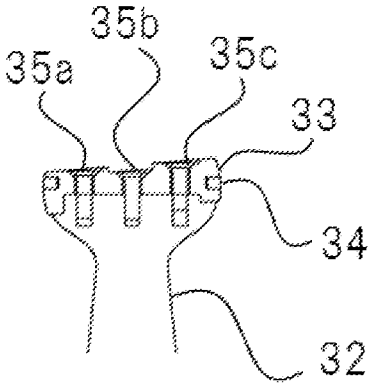
FIG. 5B is a view illustrating a method for fixing a piston in a modification example of the third embodiment.

In the present embodiment, a configuration will be described in which the reliability of the piston 33 is further improved than in the first and second embodiments. FIGS. 5A and 5B illustrate configuration examples of the piston 33 in the present embodiment.

In the first embodiment, as illustrated in FIG. 5A, a method for fixing the piston 33 is to screw a central portion at one location. The other configuration is the same as that in FIG. 3C. However, the screw 35 is likely to loosen due to the creep of a seating surface on a piston 33 side caused by the axial force of the screw 35 itself, or the momentum of a frictional force generated on the spherical outer peripheral surface 33*a* of the piston with reciprocating and oscillation.

In addition, in the first embodiment, the effect of thermal insulation of the compression chamber achieved by the piston 33 itself has been described, and strictly, compression heat is transferred to the screw 35 to heat the big end portion bearing 31 of the connecting rod via the connecting rod 32, so that thermal insulation is not perfect.

Therefore, a modification example will be illustrated as follows. First, screws 35*a*, 35*b*, and 35*c* for fixing the piston illustrated in FIG. 5B are disposed at two or more locations in the oscillation direction of the piston 33. Accordingly, the momentum arm of the frictional force generated on the spherical outer peripheral surface 33*a* of the piston is shortened, and the force that tends to unfasten the fastening screws is reduced.

Incidentally, when the piston 33 is fastened with the screws 35, 35*a*, 35*b*, and 35*c*, it is preferable that the extension of the screw itself when the required axial force is reached is large. The reason is that when a seating surface of the piston 33 is crushed by a certain amount due to the creep, if the original amount of extension of the screw is larger than the amount of crushing, a decrease in axial force can be reduced. From this point of view, it is desirable that the outermost diameter of the screw 35 is a diameter of 1/10 or less of the inner diameter of the cylinder.

Fourth Embodiment

A fourth embodiment illustrates a modification example of the spherical outer peripheral surface 33*a* of the piston based on the first and second embodiments.

In the first embodiment, the shape of the outer peripheral surface 33*a* of the piston is a spherical surface having a diameter slightly smaller than the inner diameter of the cylinder 22. In addition, in the second embodiment, the shape of the outer peripheral surface of the piston 33 in an initial state at room temperature is a spherical surface having a major diameter in the reciprocating direction and a minor diameter in the direction perpendicular thereto at the position of the top dead center such that the shape of the outer peripheral surface of the piston 33 is close to a perfect sphere when the piston 33 is subjected to thermal expansion due to compression heat during compression operation.

Figure 6A:
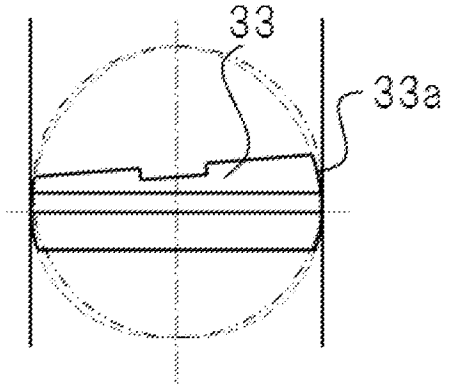
FIG. 6A is a view describing a first example of an outer peripheral surface of a piston in a fourth embodiment.
Figure 6B:
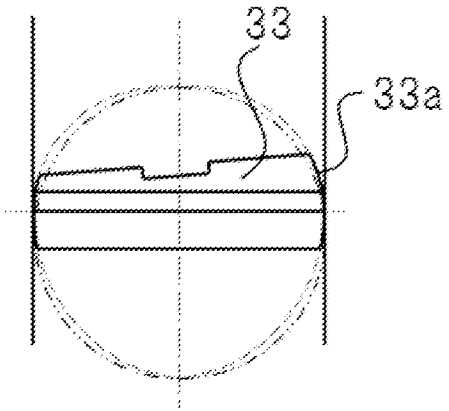
FIG. 6B is a view describing a second example of the outer peripheral surface of the piston in the fourth embodiment.
Figure 6C:
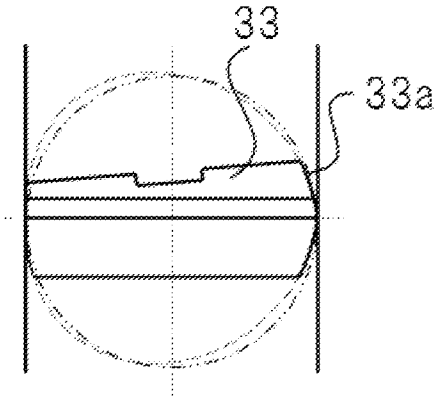
FIG. 6C is a view describing a third example of the outer peripheral surface of the piston in the fourth embodiment.

However, in addition to a simple spherical surface, there are a plurality of types of shapes that enable smooth oscillating and reciprocating motions while allowing the outer peripheral surface 33*a* of the piston to slide against the cylinder inner peripheral surface 22*a*. Examples of the shapes are illustrated in FIGS. 6A to 6C. In FIGS. 6A to 6C, a two-dot chain line depicts a circle illustrated for comparison with a curve (illustrated by a dotted line) to be described in the present embodiment.

FIG. 6A is a view describing a first example of the outer peripheral surface 33*a* of the piston. Specifically, FIG. 6A is a view illustrating a case in which the outer extension line of a cross section which passes through the center of the piston 33 and is orthogonal to a rotation axis of the crankshaft depicts a substantially oval. This shape is formed of a curved surface which is depicted such that the center point 33*d* of the oscillating motion of the outer peripheral surface 33*a* of the piston moves to a valve plate side (upper side of the figure) in a reciprocating axial direction as the absolute value of the oscillation angle increases from 0. Incidentally, in this case, the cross section which passes through the moving center of the piston 33 and is orthogonal to the central axis of the cylinder is a circle having a diameter slightly smaller than the inner diameter of the cylinder 22.

Even with such a curved surface, the same effects as those of the first and second embodiments can be obtained. Further, as a subsidiary effect, when the oscillation angle increases, the distance between the center of the big end portion bearing 31 of the connecting rod and the center point 33*d* of the oscillating motion of the piston 33 can be slightly extended, so that the maximum value of the oscillation angle can be suppressed, and the blowby loss can be reduced. In addition, since the motion trajectory of the connecting rod 32 is changed due to the influence, the inertia force changes, thereby affecting the vibration of the compressor main body.

FIG. 6B is a view describing a second example of the outer peripheral surface 33*a* of the piston. Specifically, the cross-sectional shape of FIG. 6B is formed of a curved surface which is depicted contrary to FIG. 6A such that the center point 33*d* of the oscillating motion moves to a lower side in the reciprocating axial direction as the absolute value of the oscillation angle increases from 0.

In addition, FIG. 6C is a view describing a third example of the outer peripheral surface 33*a* of the piston. Specifically, the shape of FIG. 6C is a shape obtained by laying down the shape of FIG. 6A sideways.

Similar to the shape of FIG. 6A, both the shapes affect the oscillation angle and the inertia force of the connecting rod.

Incidentally, in FIGS. 6A and 6B, the oval used in the description of three shapes of FIGS. 6A to 6C refers to the shape of a curved surface in which a cross section perpendicular to the central axis of the cylinder has a circular shape, the radius of the cross section continuously changes as the central axis of the cylinder moves, and particularly, the inclination of a portion of the curved surface, which forms the piston, monotonically increases or monotonically decreases.

In addition, the shape of FIG. 6C refers to the shape of a curved surface in which the central axis of the cylinder in the definition of the oval in FIGS. 6A and 6B is replaced with a straight line perpendicular to the central axis of the cylinder. Further, in FIGS. 6A to 6C, a crankcase 21 side surface of the piston ring 34 is configured to coincide with a cross section in which the radius of the curved surface of the oval is at the maximum.

Incidentally, the three shapes are illustrated as representative examples. Various shapes can be depicted according to a change in oscillation angle by methods other than the profile depicted by the center point 33*d* of the oscillating motion, and can be freely designed by a combination of blowby loss, vibration, and the like.

In this specification, in addition to the surface of a substantially perfect sphere as described in the first and second embodiments, various curved surfaces including the oval described in the fourth embodiment are also treated as spherical surfaces.

REFERENCE SIGNS LIST

1 Compressor main body
21 Crankcase
22 Cylinder
24 Crankshaft
32 Connecting rod
33 Piston
33*a* Spherical outer peripheral surface of piston

The invention claimed is:

1. A compressor comprising:
a piston that reciprocates inside a cylinder;
a piston ring that seals a compression chamber;
a piston ring groove;
a valve plate that closes an end portion of the cylinder;
a connecting rod that supports the piston;
a crankshaft that applies a rotating force to an end portion of the connecting rod; and
a crankcase that rotatably supports the crankshaft, wherein
the piston is an oscillating piston that reciprocates while oscillating inside the cylinder according to rotation of the crankshaft,
an outer peripheral surface of the piston is a curved surface,
a piston ring grove axis that is equidistant from a piston ring groove upper surface and a piston ring groove lower surface which faces toward the compression chamber is not parallel to an upper surface of the piston which faces toward the compression chamber,
an upper surface of the piston has a flat surface,
the piston ring groove is an annular groove in the outer peripheral surface, and includes the piston ring, which seals a compressed gas, in the annular groove, and
the curved surface is a spherical surface.

2. The compressor according to claim 1, wherein the outer peripheral surface of the piston comes into contact with an inner peripheral surface of the cylinder during reciprocating motion and slides against the inner peripheral surface.

3. The compressor according to claim 1, wherein the piston is fixed to or integrated with the connecting rod.

4. The compressor according to claim 1, wherein the piston is made of a resin having wear resistance at a location where the outer peripheral surface comes into contact with an inner peripheral surface of the cylinder.

5. The compressor according to claim 4, wherein a coefficient of thermal expansion of the resin is smaller in a direction perpendicular to a reciprocating direction than in the reciprocating direction in a state where the piston is at a top dead center.

6. The compressor according to claim 4, wherein the resin is polytetrafluoroethylene (PTFE), polyphenylenesulfide (PPS), polyethersulfone (PES), a phenolic resin, a polyimide resin, a copna resin, or a mixture of these resins.

7. The compressor according to claim 1, wherein a diameter of the spherical outer peripheral surface of the piston is larger in a direction perpendicular to a reciprocating direction than in the reciprocating direction in a state where the piston is at a top dead center.

8. The compressor according to claim 1, wherein
the piston is fastened to the connecting rod with screws, and
a plurality of the screws are disposed in an oscillation direction of the connecting rod.

9. The compressor according to claim 1, wherein
the piston is fastened to the connecting rod with a screw, and
an outermost diameter of the screw is a diameter of 1/10 or less of an inner diameter of the cylinder.

10. The compressor according to claim 1, wherein a part or an entirety of the piston is made of aluminum, and the outer peripheral surface is lubricated with an oil during operation.

11. The compressor according to claim 1,
a center point of the spherical surface is disposed on a plane obtained by extending a crankcase side surface of the piston ring groove.

12. The compressor according to claim 1, wherein the curved surface is a surface of a substantially perfect sphere.

13. The compressor according to claim 1, wherein the curved surface has a surface shape of a sphere having a diameter smaller than a diameter of the cylinder.

14. The compressor according to claim 1, wherein a center position of the crankshaft is different from a center position of the cylinder.

* * * * *